US005669561A

United States Patent [19]

Vitelli

[11] Patent Number: 5,669,561

[45] Date of Patent: Sep. 23, 1997

[54] BASKET FOR MACHINES USED TO MIX AND GRIND A NUMBER OF SUBSTANCES FOR THE PRODUCTION OF UNIFORM MIXTURES, SUCH AS THOSE EMPLOYED IN PAINTS

[76] Inventor: Renato Vitelli, Via del Casaletto, 521, IT 00151 Rome, Italy

[21] Appl. No.: 619,550

[22] PCT Filed: Sep. 26, 1994

[86] PCT No.: PCT/IT94/00154

§ 371 Date: Mar. 27, 1996

§ 102(e) Date: Mar. 27, 1996

[87] PCT Pub. No.: WO95/09043

PCT Pub. Date: Apr. 6, 1995

[30] Foreign Application Priority Data

Sep. 30, 1993 [IT] Italy ..... RM93AO663

[51] Int. Cl.[6] ..... B02C 17/02; B02C 17/16

[52] U.S. Cl. ..... 241/74; 241/171; 241/172

[58] Field of Search ..... 241/46.17, 74, 241/170, 171, 172

[56] References Cited

U.S. PATENT DOCUMENTS

| | | | |
|---|---|---|---|
| 4,967,968 | 11/1990 | Vitelli | 241/46.17 |
| 5,184,783 | 2/1993 | Hockmeyer et al. | 241/172 |
| 5,497,948 | 3/1996 | Hockmeyer | 241/46.17 |
| 5,544,821 | 8/1996 | Gupta et al. | 241/46.017 |

FOREIGN PATENT DOCUMENTS 4116421 10/1992 Germany .

*Primary Examiner*—John M. Husar

*Attorney, Agent, or Firm*—Laurence R. Brown

[57] ABSTRACT

Basket for machines for mixing and grinding a number of substances in order to produce uniform mixes, such as those used for paints, with the basket in question featuring along its perimeter a circular ring (1) bound at the inner and outer edges by micro-perforated walls (2 and 3), and with this ring functioning as a channel inside of which microspheres made of glass or of other suitable materials are placed; the central portion of the basket, when viewed from below, appears empty in the middle, with this space being bound along its perimeter by the circular channel (1).

5 Claims, 2 Drawing Sheets

BASKET FOR MACHINES USED TO MIX AND GRIND A NUMBER OF SUBSTANCES FOR THE PRODUCTION OF UNIFORM MIXTURES, SUCH AS THOSE EMPLOYED IN PAINTS

1. Technical Field

The object of this invention is a basket for the machines to mix, grind several substances in an excellent way, especially for the creation of paints.

When producing paints, especially paints for cars, it is very important that the mixing of the various components is done in a very refined way. For such purpose the basket as by this invention uses mixing balls featuring a very small diameter which are inserted into a basket equipped with an internal channel with walls perforated with small holes, in which, in order to increase the mixing and grinding qualities of the microballs there are vertical fixed carried by a disc equipped with vertical cuts against which these microballs hit. The upper surface of the basket is closed by a lid so that the products to be mixed is sucked into the basket through the walls perforated with small holes.

2. Background Art

There have long existed machines capable of mixing and grinding the elements that go into producing paints for the purpose of obtaining a uniform mix. These machines, created according to a variety of designs, have been placed under the protection of a number of patents, both Italian and foreign, by the same enterprise proposing the present patent application.

In an earlier patent, held in Italy (1,211,658), Europe (89830011.6) and the United States (U.S. Pat. No. 4,967,968) by the same enterprise, a description was given of a machine used for the simultaneous dispersion, mixing and grinding of a number of substances in order to obtain uniform mixes of a pre-established granular density, such as those employed in producing paints. The underlying principle for the operations of such a machine is the face that the elements which go into the production of the paint, meaning the film-generating substances, the pigments, the diluents, the plasticizers, the drying elements and other potential components, are introduced in appropriate doses into a receptacle and agitated inside a perforated basket which contains a mixing element and numerous marbles or other elements made from glass or from suitable materials. But although this machine make it possible to obtain excellent mixtures, it is not capable of turning out, in short periods of time, a product which meets the demands of the more difficult finishing processes, such as paints for automobiles and similar uses.

This difficulty is traceable to the fact that the basket in the traditional machine must operate using spheres which are excessively large.

One solution to the problem would be to insert spheres of a much smaller diameter in the basket. In this case, however, the size of the holes on the basket walls would also have to be reduced, and it has been found that, with smaller holes, the temperature of the material inside the basket becomes excessively high, due to the slow rate of exchange of the paint.

DISCLOSURE OF INVENTION

The subject of the present invention is a basket for machines used to mix and to grind a number of substances in order to obtain uniform mixes, such as those used to produce paints, capable of resolving the aforementioned inconveniences, and, therefore, permitting the production of paints for highly-refined finishing work in very short periods of time.

The basket proposed in the present invention has the external form of a circular ring bounded both inside and outside by a circular surface perforated with small holes, while the central, upper portion, when viewed from above, is closed off by a circular element with a small, central slot; in effect, the basket, when viewed from above, and without the other elements which complete the assembly, has the appearance, as mentioned earlier, of a circular ring, with the ring forming a channel whose walls are perforated with small holes; when viewed from below, on the other hand, the outer channel proves to be closed, while the central portion is occupied by a space which is empty, but closed at the top.

A fixed disc, or similar structure, is attached to the internal shaft, which is coaxial to that of the machine. This disc, which presents along its entire surface a series of obliquely-shaped cuts laid out in a radial array, plus a number of elements attached perpendicularly to its bottom portion, where they serve as mixers, is placed on top of the basket, on the side on which the channel is open, in such a way that the mixing elements are positioned inside the channel itself. The basket assembly is completed by a circular-shaped element which closes it off from above, and which comes with a central connecting piece for attachment to the motor shaft.

Inside the basket, or, to be more precise, inside the channel formed by the perforated walls, are inserted a certain number of small spheres made from glass, for example, or from some other material.

The basket, connected to a machine for the production of paints—a machine already covered by other patents held by the same enterprise—is inserted in a receptacle in which the substances to be mixed have been introduced. Made to rotate by this machine, the basket's special configuration, as described earlier, creates a situation in which the product to be mixed is forcefully sucked into the basket through the lateral, micro-perforated walls located on the inside of the circular ring, where it is ground and amalgamated to a perfect state by the small spheres, which are set in motion both by the rotation of the basket itself and by collisions with the mixing elements, following which the product leaves the basket through the external, micro-perforated walls, establishing inside the basket a continuous and powerful exchange of the material being processed, while making it possible to use, in place of normal spheres, spheres with a decidedly smaller diameter, which, as mentioned earlier, significantly improve the quality of the finished product, in particular when it is to be used for specialized finishing work.

The elements briefly illustrated up to this point can be better understood in the detailed description that follows, making reference to the designs enclosed as appendices, in which.

Figure 1:
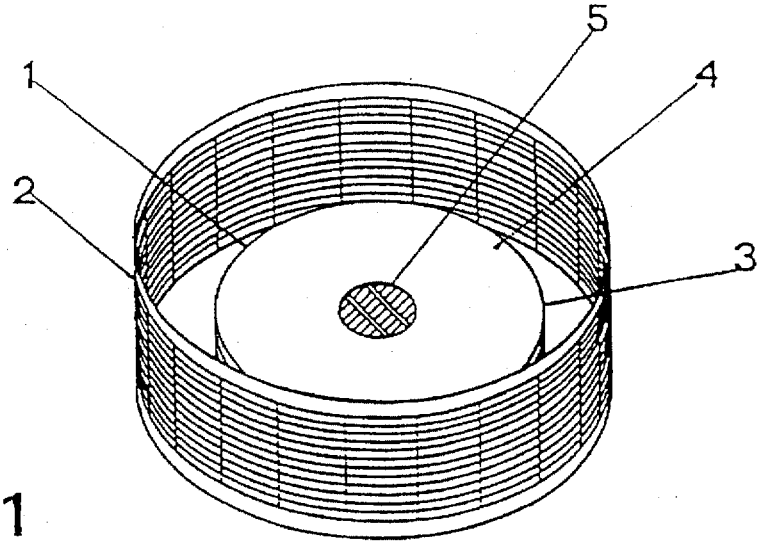
FIG. 1 shows a view of the basket from above, without the internal disc or the cover.

With regard to these illustrations, and in particular to FIG. 1, the basket featured in the present invention, when seen from above, appears in the form of a circular-shaped ring 1, which is bound on the outside by a micro-perforated wall 2, and on the inside by a micro-perforated wall 3, in such a way that the ring consists, in effect, of a channel bound on both sides, 2 and 3, by micro-perforated walls. The central portion of the basket, again when viewed from above, is closed off with a circular element, whose own center contains a series of small silts 5.

Figure 2:
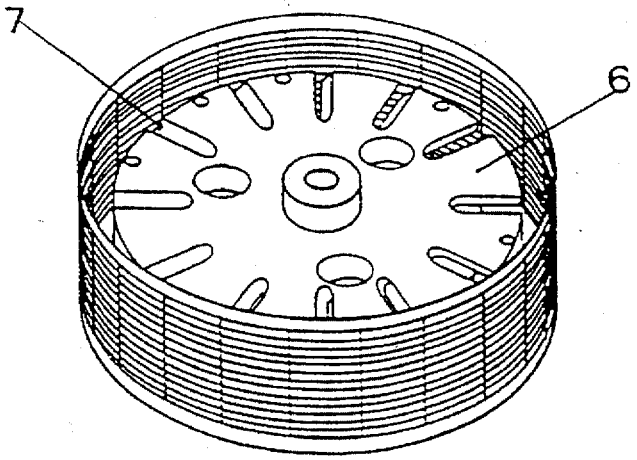
FIG. 2 shows a view of the basket from above, with the internal disc.
Figure 3:
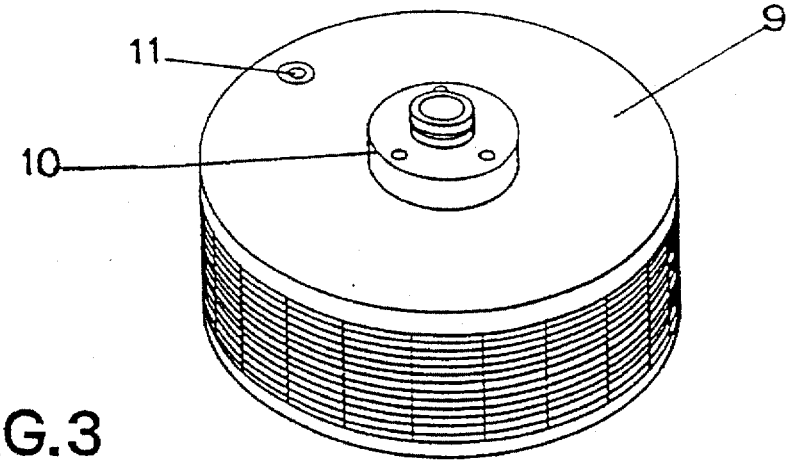
FIG. 3 shows a view of the basket from above, with all its parts.
Figure 4:
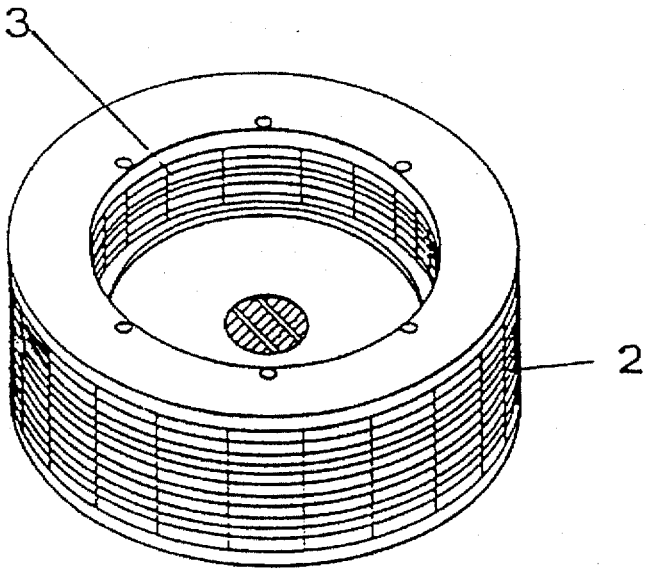
FIG. 4 shows a view of the basket from below.
Figure 5:
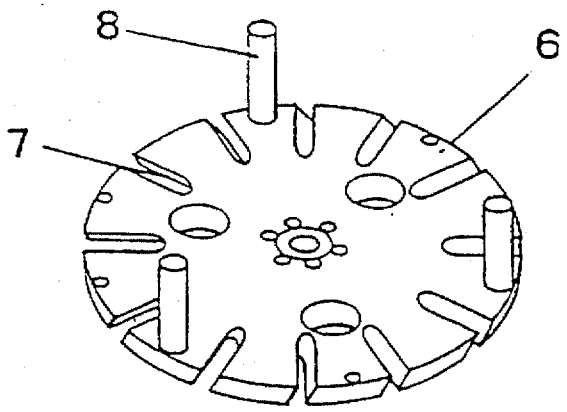
FIG. 5 shows a view of the layout of the disc from the side which normally faces the inside of the basket.
Figure 6:
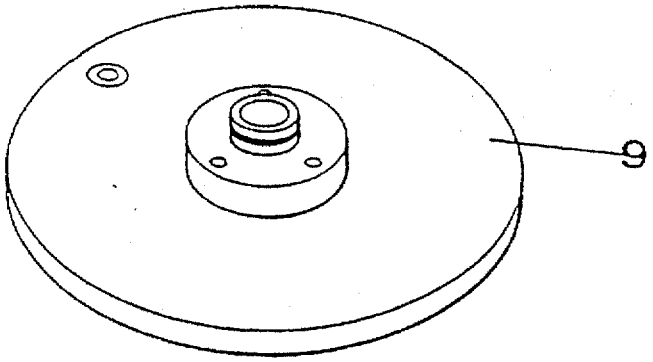
FIG. 6 shows a view of the cover from above.

When viewed from below, as illustrated in FIG. 4, the basket appears with the portion corresponding to the circular ring 1 being closed and bounded by an empty central space. The basket, when viewed from above, as shown in FIG. 2, is covered with a fixed disc 6, which is of one piece with the internal shaft, itself coaxial to the drive shaft of the machine (not shown); the principal characteristics of the disc are the presence of a series of slots (7) positioned in a radial layout and cut at a rising slant, in such a way that the small spheres circulating inside the basket while the machine is in operation are sent back into the circular section, plus a number of elements (8), 3 in the example, which are of one piece with the internal face of the disc 6, and which serve to agitate the spheres when the basket is set in motion. Placed above the disc 6, to close off the basket, is the cover 9, which presents at its center the support piece 10 for attachment to the motor of the mixing machine which sets the basket in motion during the actual operations. A small hole (11) equipped with a tap makes it possible to replace any spheres which have worn out during the operations of the machine. Naturally, the cover 9 is attached by screws or by other sealing devices to the body of the basket.

The basket, as described up to this point, makes it possible, as mentioned earlier, to prepare highly-refined paint mixes, given that it is designed to create, inside the circular section 1 of the basket, a continuous, driven exchange of the material to be processed once the basket is set in motion by the mixing machine inside the container where the materials to be processed are introduced. The configuration of the basket designed around the circular ring 1, at the active portion of the basket, creates a situation in which the material to be processed is forcefully sucked into the basket through the micro-perforated internal walls 3, where it is refined and amalgamated by the micro-spheres present inside the circular ring 1, at which point it is discharged through the external micro-perforated walls 2 of the circular ring, creating, inside this ring 1, a level of motion and exchange of the materials which is decidedly higher than the level made possible using the traditional basket, with the result being a more effective cooling of the materials being processed, due also to the small size of the holes on the walls of the basket, and making possible the use of micro-spheres which, as mentioned earlier, permit the production of more highly-refined mixes in short periods of time for special paints, such as those used on automobiles.

The same operating principal described and illustrated above also makes it possible, despite the fact that the walls of the basket, as mentioned earlier, are perforated with very small holes in order to keep the small spheres from escaping, to obtain easy cleaning of the basket when changing from one mixing process to the next, thanks to the evacuation of the basket produced by the centrifugal forces when the it is rotated at high speed, with the result that, by simply immersing the basket in a solvent and operating the machine for a few minutes, perfect cleaning is achieved with a minimal waste of solvent and obvious advantages in terms of both cost-savings and pollution.

I claim:

1. A basket for mixing and grinding substances to produce uniform mixes, comprising in combination:

a basket comprising an internal circular ring shaped channel having a closed bottom wall, inner and outer micro-perforated side wall means, and an open top;

micro-spheres within said ring shaped channel;

a rotary drive shaft;

a disc attached to said drive shaft for coaxial rotation with said ring shaped channel, said disk having micro-sphere rotating elements comprising a plurality of mixing elements perpendicular thereto extending downwardly into said channel and mixing slots in said disc; and a cover for closing the open top of said basket and passing said drive shaft therethrough;

whereby rotation of said disc forcefully passes said mixes into and out of the basket through the side wall means to thereby encounter the rotation micro-spheres.

2. The basket defined in claim 1 wherein said side wall means further comprises two spaced micro-perforated side walls of said basket coaxially surrounding said disc.

3. The basket defined in claim 1 wherein said mixing elements are rod elements on the periphery of said disc disposed on only one side of said disc to produce centrifugal forces when the disc is rotated for both sucking the mixes into the basket through the side wall means and discharging the mixes from the basket.

4. The basket defined in claim 1 wherein said mixing slots comprise a plurality of peripheral slots radially extending inwardly and passing through said disc.

5. The basket defined in claim 1 wherein said disc comprises an internal basket having a circumferential micro-perforated sidewall comprising said inner wall side wall means.

* * * * *